US006736151B2

(12) United States Patent
Lin et al.

(10) Patent No.: US 6,736,151 B2
(45) Date of Patent: May 18, 2004

(54) ANTI-WINDFORCE RIB ASSEMBLY OF MULTIPLE-FOLD UMBRELLA

(75) Inventors: Chung-Kuang Lin, Taipei Hsien (TW); Jung-Jen Chang, Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 76 days.

(21) Appl. No.: 10/135,358

(22) Filed: May 1, 2002

(65) Prior Publication Data

US 2003/0205264 A1 Nov. 6, 2003

(51) Int. Cl.[7] ..... A45B 3/00
(52) U.S. Cl. ..... 135/31; 135/22
(58) Field of Search ..... 135/22, 24, 25.3, 135/25.31, 29, 31, 23

(56) References Cited

U.S. PATENT DOCUMENTS 5,048,550 A * 9/1991 Su ..... 135/25.3
5,144,971 A * 9/1992 Seidel et al. ..... 135/22
5,178,174 A * 1/1993 Wu ..... 135/22
5,551,463 A * 9/1996 Wang ..... 135/25.3
5,645,094 A * 7/1997 Wu ..... 135/24
6,170,498 B1 * 1/2001 Wu ..... 135/24
6,360,759 B1 * 3/2002 Lin et al. ..... 135/24
6,588,439 B2 * 7/2003 Wu ..... 135/27
2003/0079765 A1 * 5/2003 Lin et al. ..... 135/16

FOREIGN PATENT DOCUMENTS

GB 2261601 * 5/1993

* cited by examiner

*Primary Examiner*—Janet M. Wilkens
(74) *Attorney, Agent, or Firm*—Troxell Law Office PLLC

(57) ABSTRACT

An anti-windforce rib assembly of multiple-fold umbrella includes: a spring rib connected between an inner rib and an outer rib of the rib assembly, a buffer device formed on the spring rib and connected to the inner rib, whereby upon blowing of a strong wind to the rib assembly, the force of the strong wind will be dampened, weakend or released by the buffer device on the spring rib to minimize the wind force acting upon the rib assembly to prevent from bending, deformation, breakage or damage of the umbrella rib assembly.

8 Claims, 6 Drawing Sheets

ANTI-WINDFORCE RIB ASSEMBLY OF MULTIPLE-FOLD UMBRELLA

BACKGROUND OF THE INVENTION

A conventional multiple-fold umbrella, when subjected to strong wind force, may be inverted to upwardly bend the rib assembly to easily bend, twist, deform or break the umbrella ribs, especially a stretcher rib or a top rib adjacent to the central shaft when such a rib is made of aluminum alloy with light weight but poor mechanical strength, thereby easily damaging the umbrella ribs and shortening the service life of the umbrella.

The present inventor has found the drawbacks of the conventional umbrella rib assembly and invented the present anti-windforce rib assembly for multiple-fold umbrella.

SUMMARY OF THE INVENTION

The object of the present invention is to provide an anit-windforce rib assembly of multiple-fold umbrella including: a spring rib connected between an inner rib and an outer rib of the rib assembly, a buffer device formed on the spring rib and connected to the inner rib, whereby upon blowing of a strong wind to the rib assembly, the force of the strong wind will be dampened, weakened or released by the buffer device on the spring rib to minimize the wind force acting upon the rib assembly to prevent from bending, deformation, breakage or damage of the umbrella rib assembly.

DETAILED DESCRIPTION

Figures 1, 2:
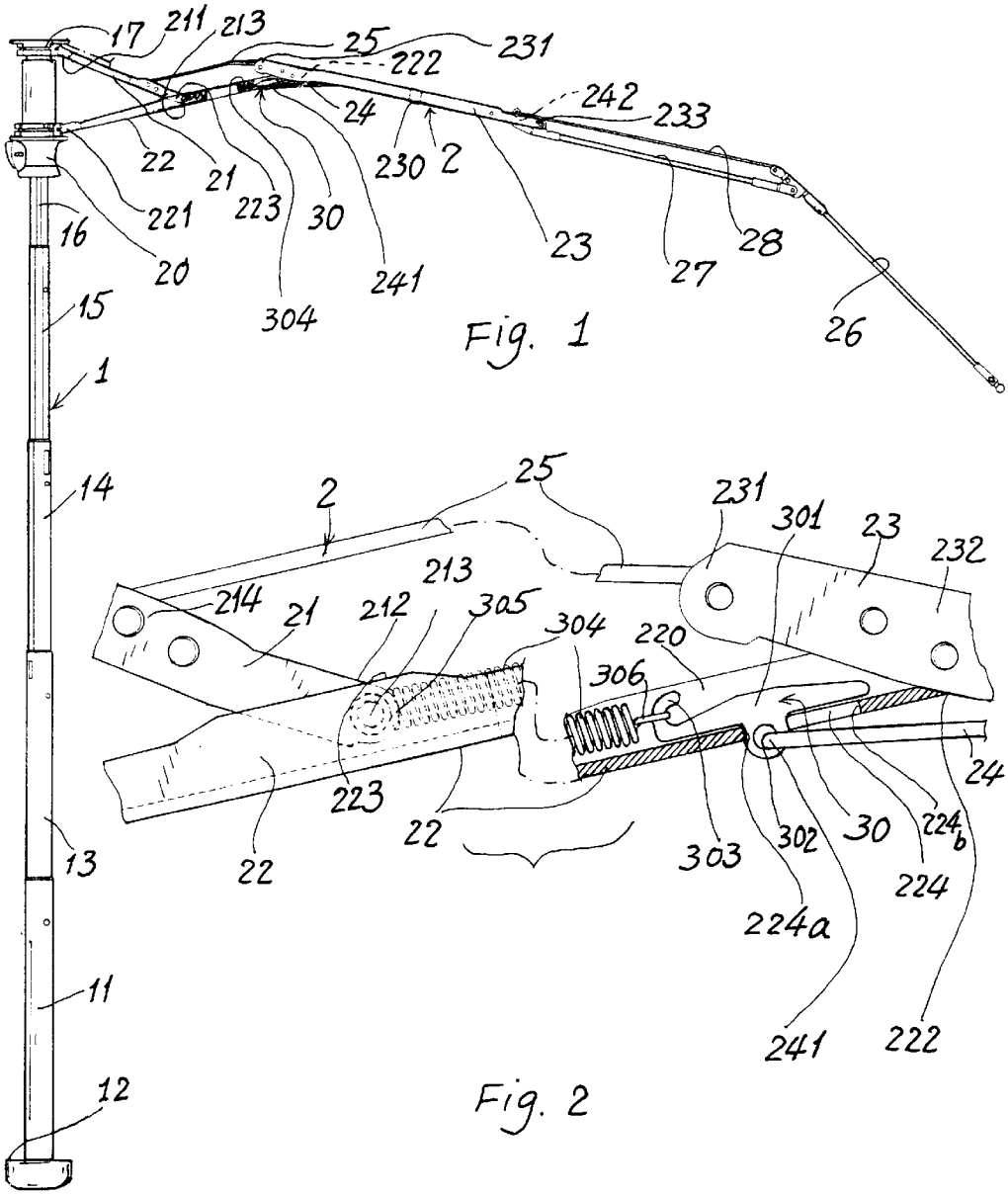
FIG. 1 shows an open umbrella of a first preferred embodiment of the present invention.
FIG. 2 is a partially enlarged view of the present invention of FIG. 1.

As shown in FIGS. 1~4, the present invention comprises a rib assembly 2 for resisting wind or external force for use in a multiple-fold umbrella including quadruple folds, triple folds and a plurality of folds of an umbrella having an umbrella cloth secured on the rib assembly pivotally connected to a central shaft 1. The number of folds are not limited in the present invention. The central shaft 1 as shown in FIG. 1 includes: a lower tube 11 having a grip 12 formed thereon, a first middle tube 13, a second middle tube 14, an upper tube 15 and an uppermost tube 16 telescopically engageable with one another, having an upper notch 17 formed on a top of the central shaft 1. The present invention is especially provided for protecting the rib assembly having ribs made of aluminum alloy or other materials having poor mechanical strength.

The anti-windforce rib assembly 2 of the present invention comprises a spring rib 24 juxtapositionally coupled to an intermediate rib 23 connected between an "inner rib" and an "outer rib" of the rib assembly 2 and a buffer device 30 formed on (or secured with) the spring rib 24 to be secured to the "inner rib". The "inner rib" in this invention indicates a rib adjacent to the central shaft 1, while the "outer rib" indicating a rib distal from the central shaft 1 and opposite to the "inner rib".

The rib assembly 2 as shown in the drawing figures includes: a top rib 21 having its inner end 211 pivotally secured to the upper notch 17 on the shaft 1, a stretcher rib 22 having an inner end 221 pivotally secured to a lower runner 20 slidably held on the shaft 1 and having a middle portion 223 of the stretcher rib 22 pivotally connected with an outermost end 212 of the top rib 21 by a pivot 213, an intermediate rib 23 having an innermost end 231 pivotally secured to the top rib 21 by an inner connecting rib 25 and having an inner portion 232 of the intermediate rib 23 pivotally connected with an outer end 222 of the stretcher rib 22, a spring rib 24 slidably or juxtapositionally coupled to (a groove in) the intermediate rib 23 by a coupling 230 and connected to the stretcher rib 22 by the buffer device 30 of this invention, and a tail (or outermost) rib 26 pivotally connected to an outer end 233 (or outer portion) of the intermediate rib 23 respectively by an outer connecting rib 27 and an outer spring rib 28.

The outer connecting rib 27 is also pivotally connected to an outer end 242 of the spring rib 24. The inner connecting rib 25 has its inner end pivotally connected with an outer portion 214 (adjacent to an outermost end 212) of the top rib 21.

The stretcher rib 22 or the top rib 21 may be defined or considered as the "inner rib" of the rib assembly 2; while the tail rib 26, the outer connecting rib 27 and the outer spring rib 28 may be referred to the "outer rib" of the rib assembly 2 in accordance with the present invention.

Figures 3, 4:
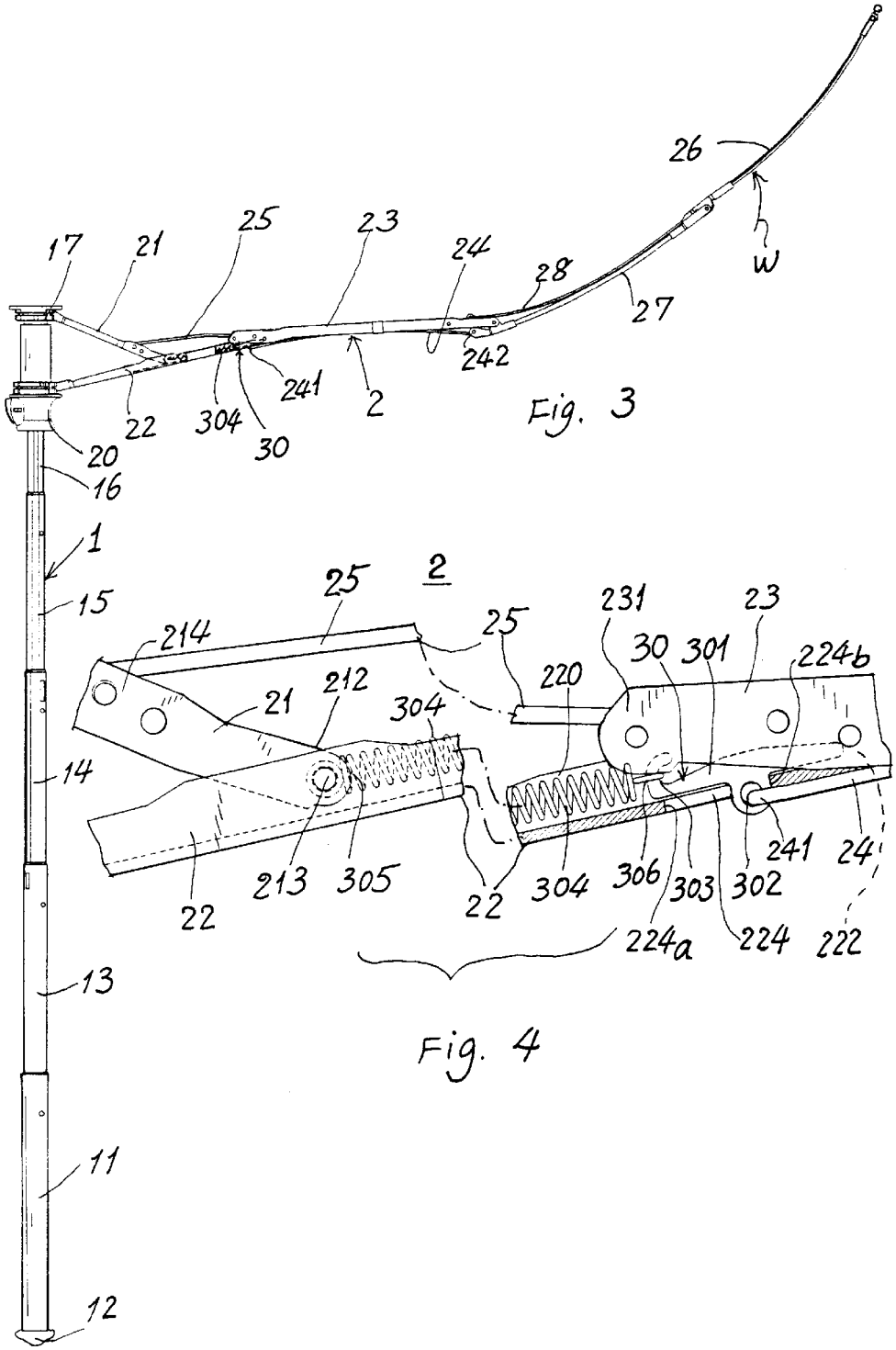
FIG. 3 is an illustration showing the umbrella of the present invention when subjected to a wind force.
FIG. 4 is a partially enlarged view of the present invention of FIG.
Figures 5, 6:
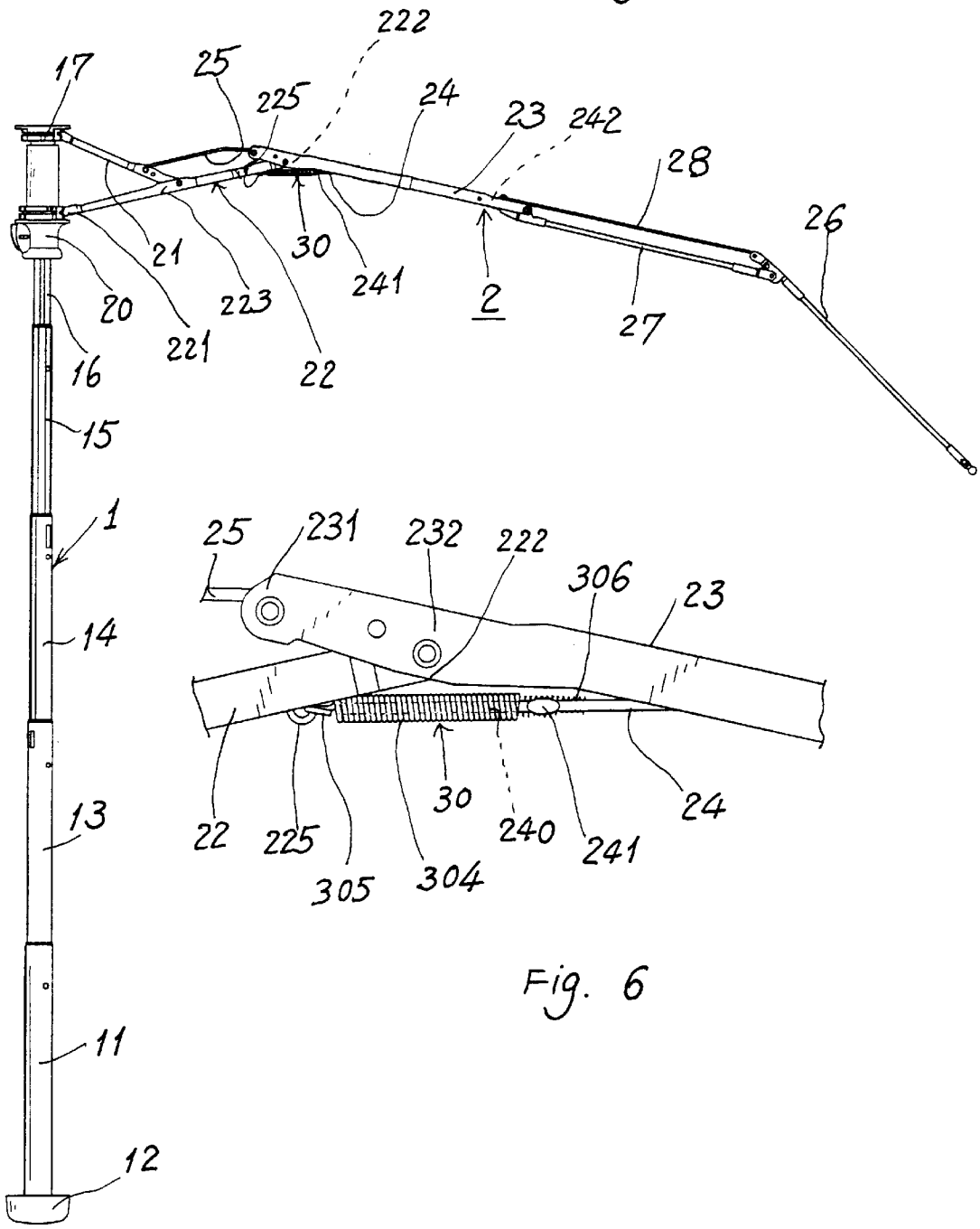
FIG. 5 shows an open umbrella of a second embodiment of the present invention.
FIG. 6 shows a partially enlarged rib assembly of FIG. 1.

The buffer device 30 of the present invention includes: a slide member 301 slidably held in a groove 220 longitudinally recessed in the stretcher rib 22 as shown in FIGS. 2, 4 and secured to an inner end 241 of the spring rib 24; and a tension spring 304 connected between the slide member 301 and a rib portion of the stretcher rib 22 (or the "inner rib"). For instance, the tension spring 304 may be secured to a pin 213 fixed on the stretcher rib 22; with the pin 213 also serving for pivotally connecting an outer end 212 of the top rib 21 with a middle portion 223 of the stretcher rib 22.

The tension spring 304 has its inner spring end 305 secured to the pin 213 on the stretcher rib 22, and having an outer spring end 306 secured to a hook (or fixing) portion 303 of the slide member 301.

The slide member 301 includes: a lug 302 protruding outwardly from the slide member 301 slidably engageable in a groove 220 of the stretcher rib 22 for connecting an inner end 241 of the spring rib 24; with the lug 302 slidably engageable with a slot 224 cut in a bottom portion of the stretcher rib 22, having an inner slot end **224*a* and an outer slot end 224*b* for limiting a reciprocative sliding stroke of the lug 302 of the slide member 301 when slidably held in the stretcher rib 22 when subjected to a wind force W (FIG. 3) or when releasing the wind force. The length of the slide member 301 in the groove 220 of the stretcher rib 22 should be greater (longer) than that of the slot 224 to prevent from decoupling of the slide member 301 from the groove 220 of the stretcher rib 22**.

When the umbrella of the present invention is subjected to a strong wind (or external) force W to invert the rib assembly 2 upwardly from FIG. 1 to FIG. 3, the wind force W will also pull the tension spring 304 of the present invention through the spring rib 24 and the slide member 301 connected to the spring 304 so that the wind force W will be dampened, weakened, and the vibration force caused by the wind force W will also be absorbed by the tension spring 304 to thereby greatly minimize the force acting upon the "inner ribs" (the stretcher rib 22 and the top rib 21) of the rib assembly 2 for preventing from bending, twisting, deformation, breakage or damage of the rib assembly for prolonging the service life of the umbrella to be superior to a conventional multiple-fold umbrella.

The buffer device 30 may be optionally positioned on the rib assembly 2, not limited in the present invention.

The buffer device 30 may be modified to be another preferred embodiment as shown in FIGS. 5~8, in which the buffer device 30 is modified and simplified to be a tension spring 304 only, having an inner spring end 305 secured to a lug (or protrusion) 225 formed on the stretcher rib 22, and an outer spring end 306 secured with the inner end 241 of the spring rib 24.

Figures 7, 8:
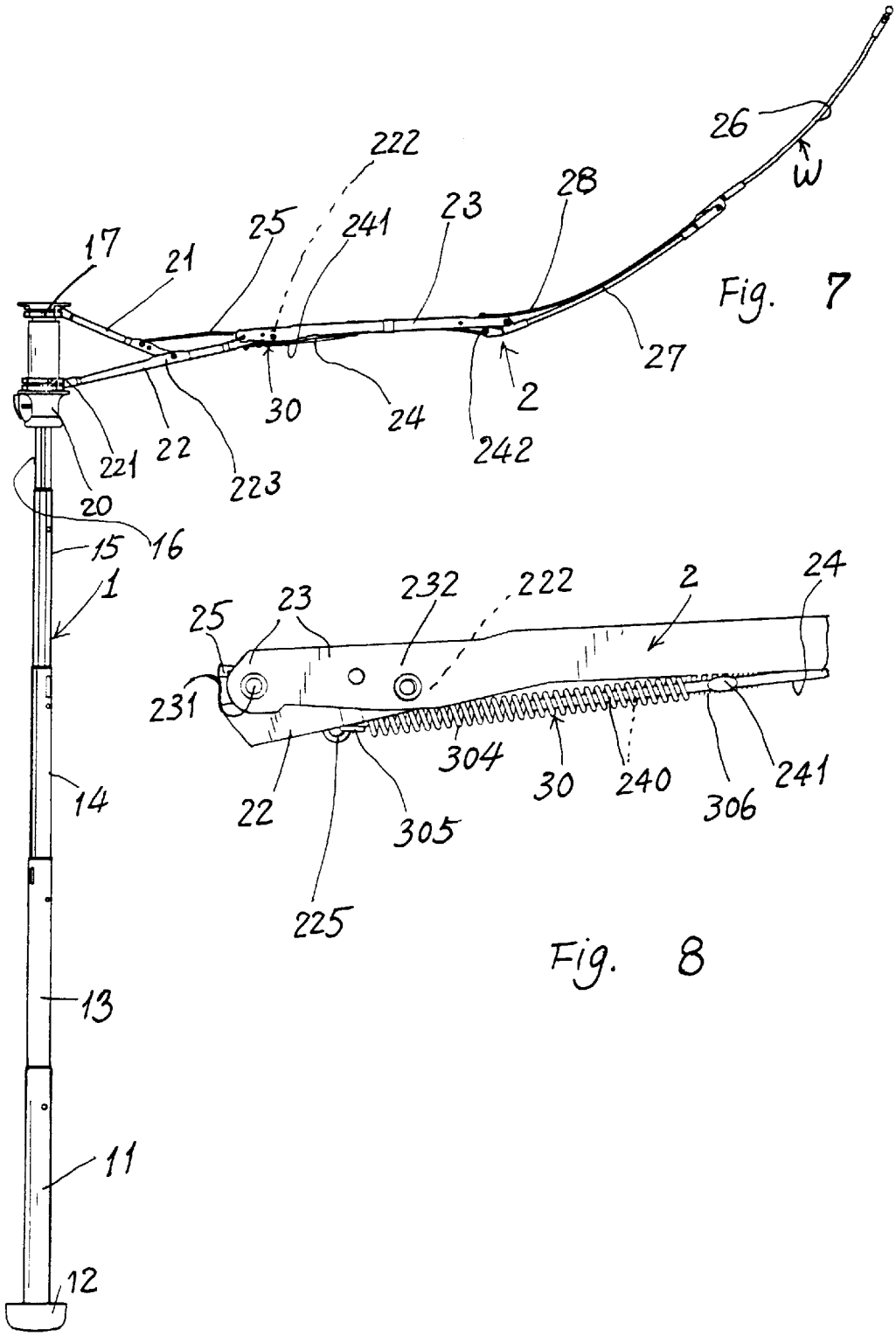
FIG. 7 shows an inverted umbrella when subjected to wind force from FIG. 5.
FIG. 8 shows a partially enlarged rib assembly of FIG. 7.
Figures 9, 10:
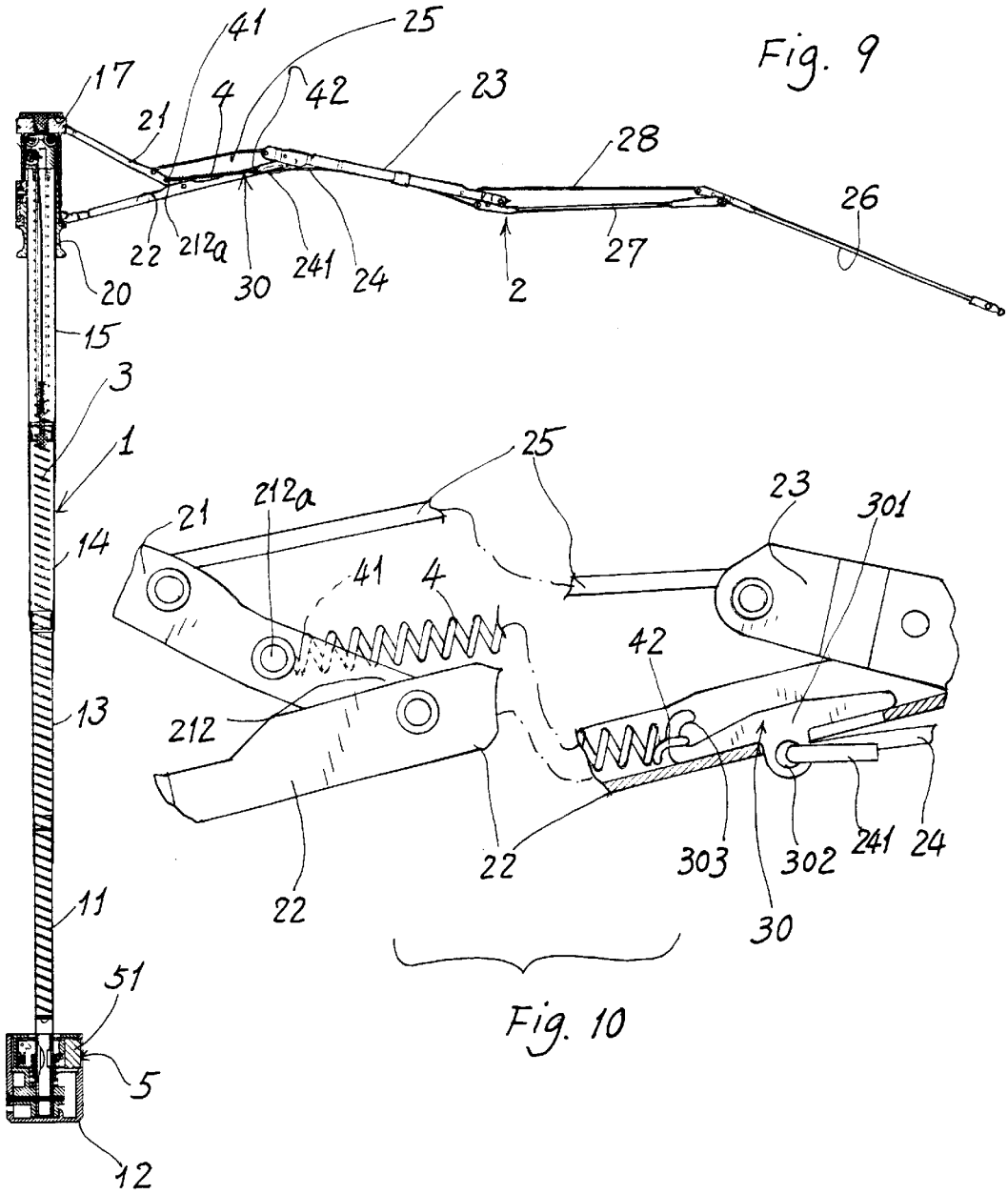
FIG. 9 shows a third embodiment of the present invention when opened.
FIG. 10 is a partially enlarged view of FIG. 9.

When the umbrella is inverted by the wind force W as shown in FIGS. 7, 8, the tension spring 304 will dampen or weaken the wind force acting upon the rib assembly for a safe protection of the rib assembly of the umbrella.

The spring rib 24 has its inner end 241 formed as a stopping portion to be retained in a contracted outer spring end 306 of the tension spring 304 (FIGS. 6, 8), and a guiding rod portion 240 formed on an inner portion of the spring rib 24 to be slidably engageable in the spring rings of the tension spring 304 for reciprocatively guiding the spring rings of the tension spring 304, when extending or retracting the rib assembly when opening or closing the umbrella, for preventing from bending or tangling of the tension spring 304 and for enhancing a smooth operation for opening or closing the umbrella.

The tension spring 304 of the buffer device 30 may also be integrally formed with the inner end 241 of the spring rib 24 for the multiple-fold umbrella with simpler mechanism and cheaper cost.

As shown in FIGS. 9~12, still another preferred embodiment of the present invention is disclosed to be adapted for an automatic opening and closing umbrella, which comprises: a central shaft 1, a rib assembly 2 pivotally secured to the central shaft 1, an opening spring 3 for opening the umbrella and retained in the shaft 1, a plurality of closing springs 4 respectively secured on the rib assembly 2 for closing the umbrella from its opening state, and a control means 5 including a push button 51 provided in a grip 12 of the shaft 1 for controlling the opening and closing of the automatic umbrella. The central shaft 1 includes: a lower tube 11, a first middle tube 13, a second middle tube 14 and an upper tube 15 telescopically engageable with one another. The mechanism of the automatic opening and closing umbrella is so conventional and will not be described in the specification.

The buffer device 30 may be the same mechanism or structure as shown in the embodiment as aforementioned and illustrated in FIGS. 1~4. The tension spring 304 may be formed in situ by using the closing spring 4 of the automatic opening and closing umbrella to be the "tension spring" of the buffer device 30. That is to say the closing spring 4 of the automatic umbrella as shown in FIGS. 9~12 playing double duties, both for serving as the closing spring for closing the umbrella as usually found in an automatic umbrella and for serving as the tension spring of the buffer device 30 as taught in this invention.

The slide member 301 of the buffer device 30 is slidably engageable in the groove 220 recessed in the stretcher rib 22, having a lug 302 protruding outwardly from the slide member 301 to be secured with the inner end 241 of the spring rib 24, and having a hook portion 303 of the slide member 301 connected with the outer spring end 42 of the closing spring 4 (also serving as "tension spring" of the buffer device 30).

The closing spring 4 has its inner spring end 41 secured to a pin 212*a* fixed on an outer portion of the top rib 21 adjacent to an outer end 212 of the top rib 21.

Figures 11, 12:
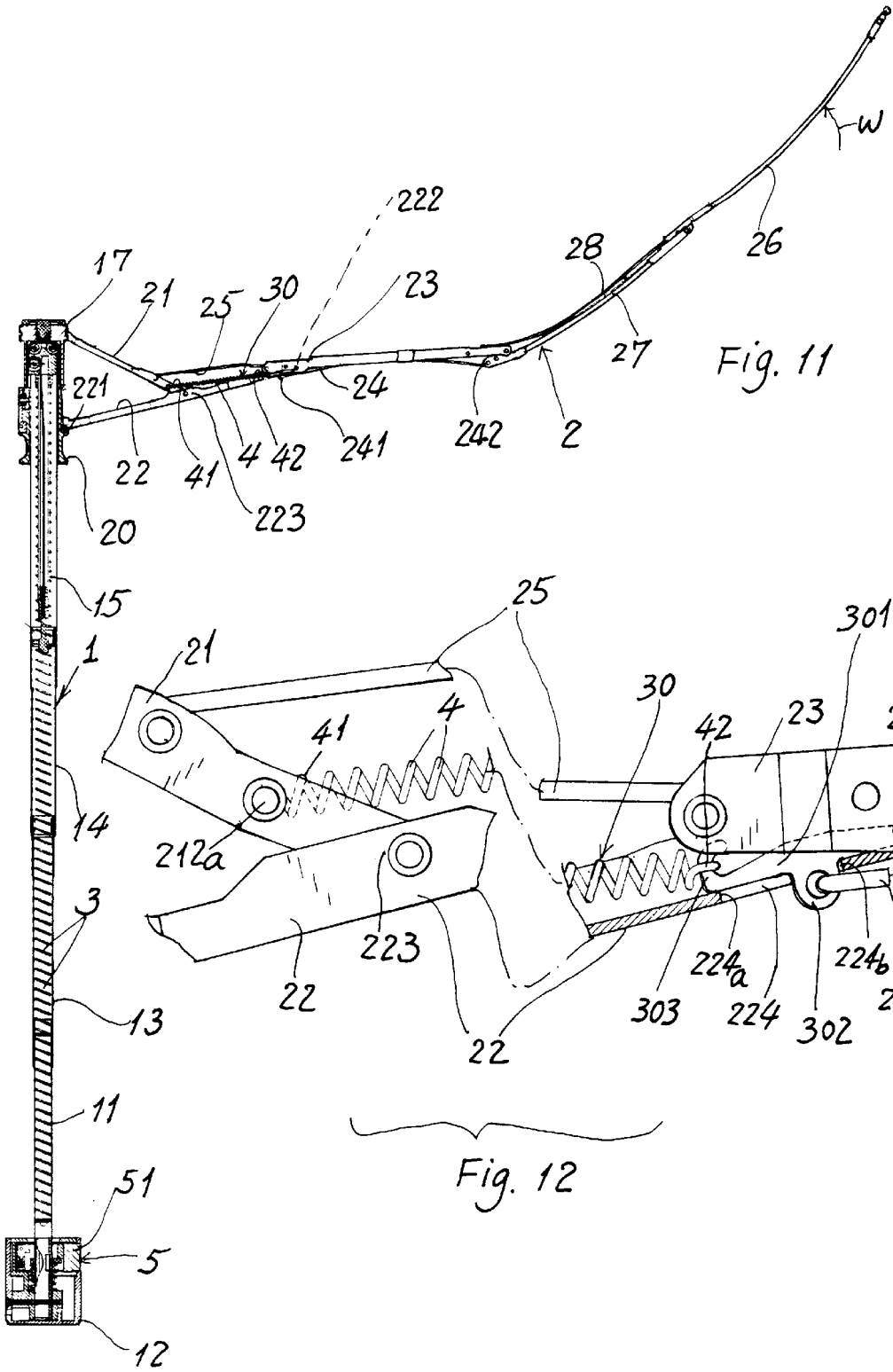
FIG. 11 shows an inverted umbrella from FIG. 9.
FIG. 12 shows a partially enlarged rib assembly of FIG. 11.

Upon inverting by a strong wind force W as shown in FIGS. 11, 12, the wind force will pull the spring rib 24 and subsequently pull the spring 4 so that the wind force will be dampened or weakened to prevent from damage to the rib assembly 2 of the automatic umbrella.

The present invention may be modified without departing from the spirit and scope of the present invention. The tension spring 304, for instance, may be substituted with a resilient member made of elastomers or other elastic materials for the buffer of the wind or external force acting upon the umbrella ribs.

I claim:

1. A rib assembly of multiple-fold umbrella comprising:

an inner rib pivotally secured to and adjacent to a central shaft, an outer rib distal from said central shaft and opposite to said inner rib, an intermediate rib and a spring rib respectively connected between said inner rib and said outer rib, with said spring rib juxtapositionally coupled to said intermediate rib;

a said inner rib including top rib pivotally secured to an upper notch formed on a top of said central shaft, and a stretcher rib pivotally secured to said top rib and pivotally secured to a runner slidably held on said central shaft, an inner connecting rib pivotally connected between said top rib and said intermediate rib, said spring rib slidality coupled to said intermediate rib, and said outer rib including a tail rib respectively pivotally connected to said intermediate rib through an outer connecting rib and an outer spring rib, with said outer connecting rib pivotally connected to said spring rib; wherein said spring rib includes a buffer device formed on said spring rib and secured to said stretcher rib for dampening a wind or external force acting upon the rib assembly for preventing damage to the rib assembly.

2. A rib assembly according to claim 1, wherein said buffer comprises a slide member slidably engaging in a groove recessed in said stretcher rib and connected to an inner end of said spring rib; and a tension spring connected with said slide member and secured to said stretcher rib.

3. A rib assembly according to claim 2, wherein said tension spring has an inner spring end secured to a pin fixed on said stretcher rib, and an outer spring end of said tension spring secured to a hook portion formed on said slide member.

4. A rib assembly according to claim 2, wherein said slide member includes a lug protruding outwardly from said slide member, through a slot cut in a bottom of said stretcher rib, for connecting the inner end of said spring rib, said lug of said slide member operatively reciprocatively sliding in said slot and limited in said slot when pulling or releasing said spring rib and said tension spring.

5. A rib assembly according to claim 1, wherein said buffer device includes a tension spring having an inner spring end secured to said stretcher rib, and an outer spring end secured to the inner end of said spring rib.

6. A rib assembly according to claim 5, wherein said spring rib has its inner end formed as a stopping portion to be retained in a contracted outer spring end of said tension spring, and a guiding rod portion formed on an inner portion of said spring rib to reciprocatively guide the tension spring about said guiding rod portion of said spring rib.

7. A rib assembly according to claim 1, wherein said buffer device includes a tension spring integrally formed with said spring rib.

8. A rib assembly according to claim 1, wherein said buffer device includes a slide member slidably engaged with said stretcher rib of said rib assembly and a tension spring forming a closing spring of an automatic umbrella, and said tension spring retained between said slide member and said top rib of said rib assembly.

* * * * *